United States Patent [19]

Heimann

[11] 4,032,065

[45] June 28, 1977

[54] FILE FOLDER WEB OF INDETERMINATE LENGTH

[76] Inventor: Egon Heimann, Falkenberg 61, D-56 Wuppertal-Elberfeld, Germany

[22] Filed: Apr. 1, 1975

[21] Appl. No.: 564,219

[30] Foreign Application Priority Data

Apr. 3, 1974 Germany ..... 2416247
Dec. 18, 1974 Germany ..... 2459741

[52] U.S. Cl. ..... 229/69; 282/11.5 A
[51] Int. Cl.[2] ..... B65D 27/10
[58] Field of Search ..... 229/69; 282/11.5 A, 282/11.5 R

[56] References Cited

UNITED STATES PATENTS

| | | | |
|---|---|---|---|
| 1,611,585 | 12/1926 | Forman | 229/69 X |
| 1,922,296 | 8/1933 | Johnson | 282/11.5 A |
| 3,208,662 | 9/1965 | Johnson | 229/69 |
| 3,733,770 | 5/1973 | Erickson | 229/69 |
| 3,786,984 | 1/1974 | Malenge | 229/69 |
| 3,817,445 | 6/1974 | Greason | 229/69 |

*Primary Examiner*—Stephen P. Garbe
*Attorney, Agent, or Firm*—Spencer & Kaye

[57] ABSTRACT

A file folder web of indeterminate length formed of a series of interconnected individual file folders each having a length and a width, has upper and lower sheets of indeterminate length arranged face-to-face and constituting, respectively, a front and a rear cover wall of each individual file folder; main weakened lines provided in the sheets and extending along and through the length dimension of each file folder; a strip of adhesive extending between the sheets along the length of each file folder adjacent the main weakened line along one longitudinal edge of each file folder for bonding together the sheets.

19 Claims, 16 Drawing Figures

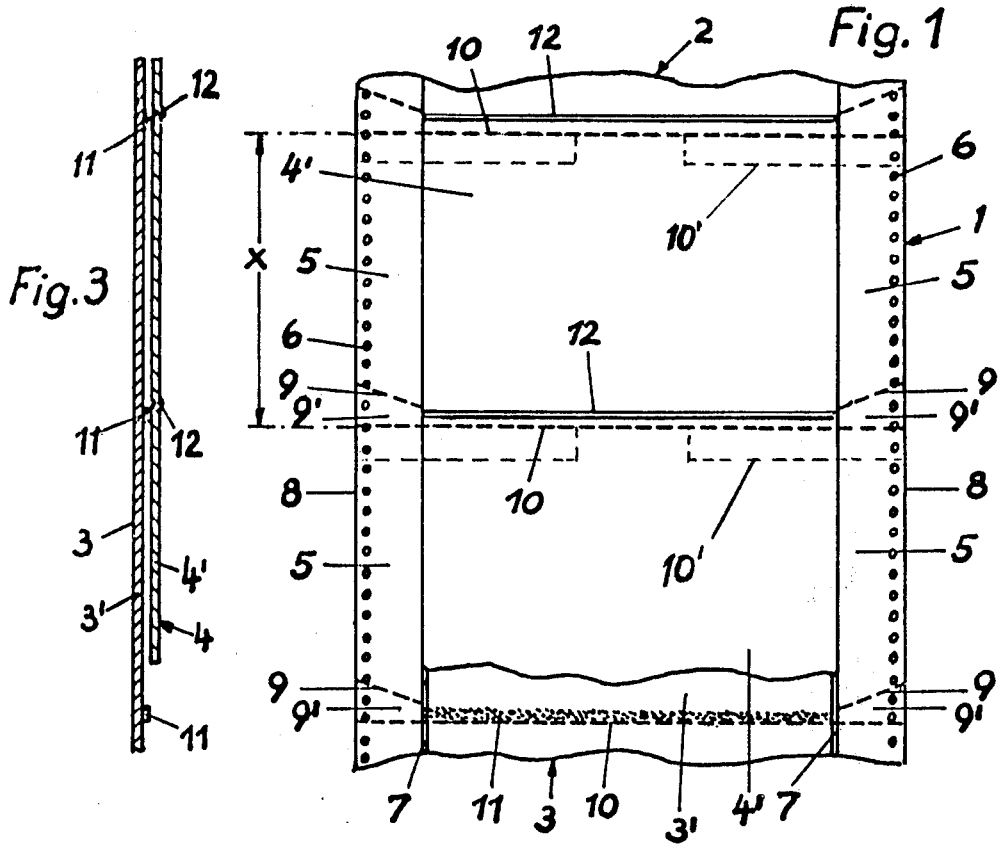
Fig. 1
Fig. 3
10
12
2
11
4'
6
10'
1
X
5
12
9
9'
8
3
4'
3'
4
7
11
3
10
3'
4'
7
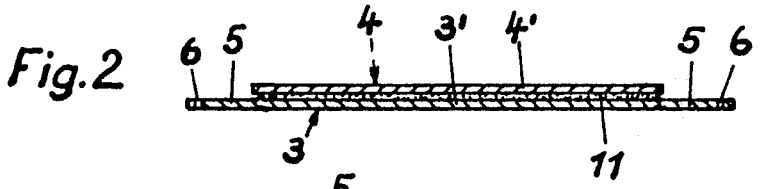
Fig. 2
6
5
4
3'
4'
5
6
3
11
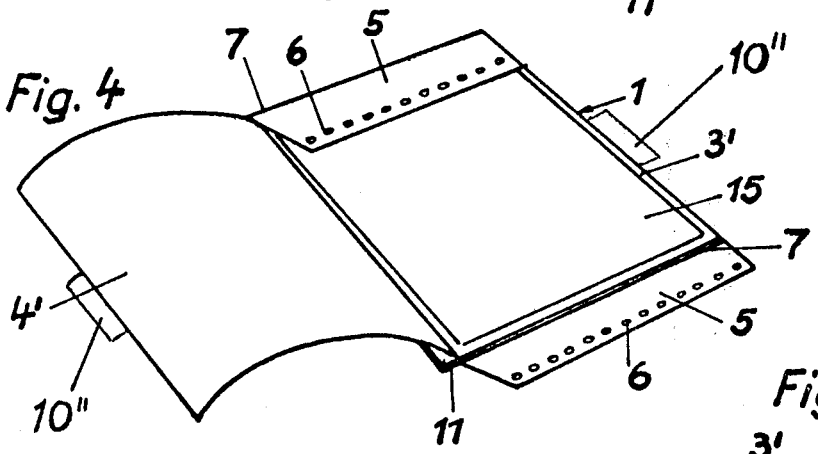
Fig. 4
7
6
5
10''
1
3'
15
7
4'
5
6
10''
11
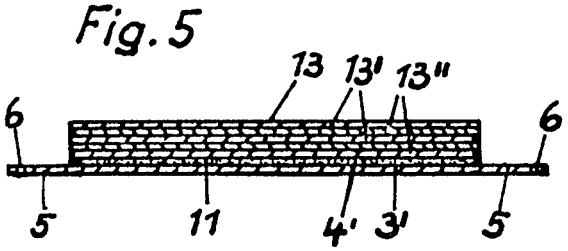
Fig. 5
13
13'
13''
6
6
5
11
4'
3'
5
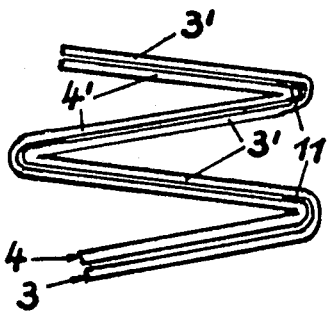
Fig. 6
3'
4'
3'
11
4
3

Fig. 12
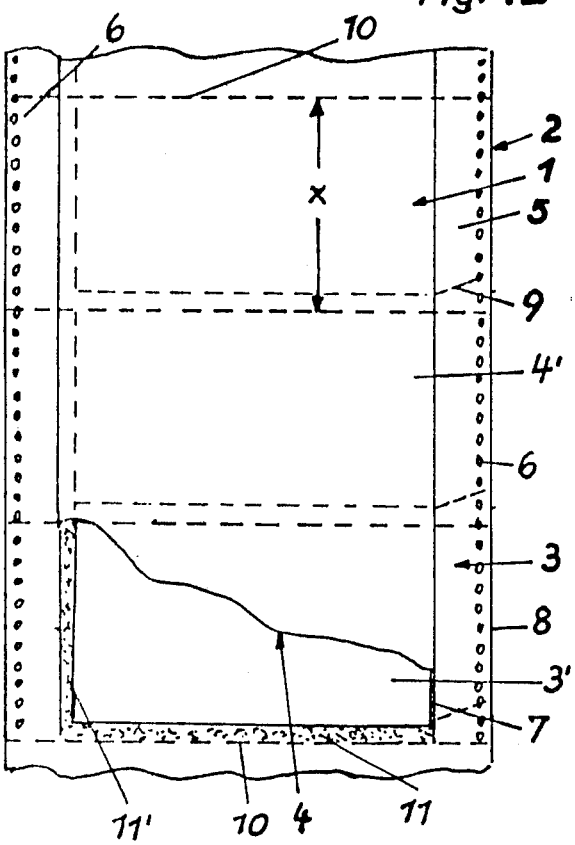
Fig. 13
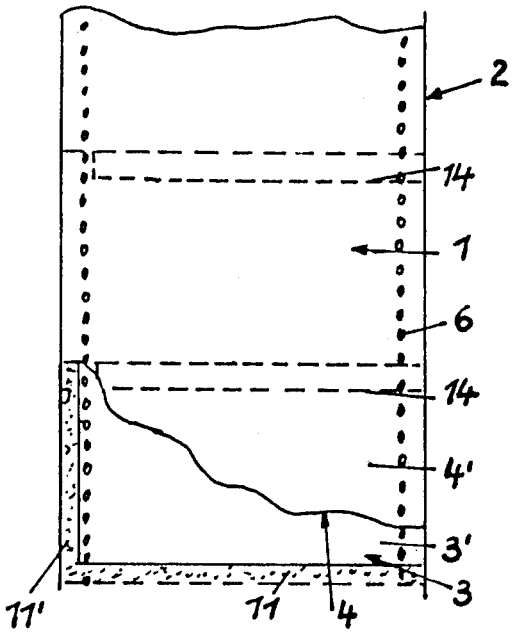
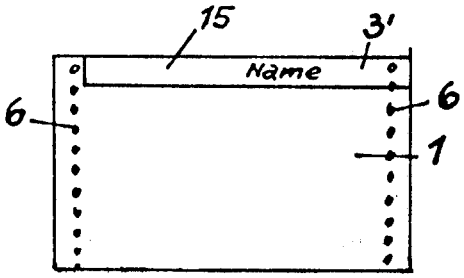
Fig. 14
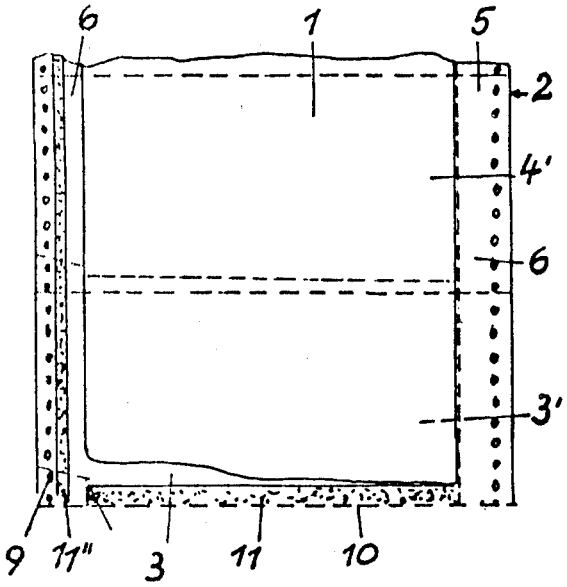
Fig. 15
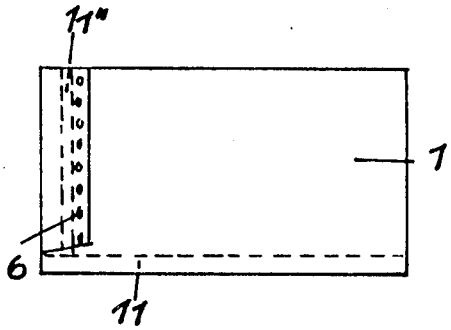
Fig. 16

FILE FOLDER WEB OF INDETERMINATE LENGTH

BACKGROUND OF THE INVENTION

This invention relates to file folders serially connected to constitute a web of indeterminate length. The web is formed of two face-to-face oriented sheets and is, at the supply end, rolled up or folded in a zigzag manner. Expediently, the web has a hole series extending lengthwise at the web edges for cooperation with paper feed sprockets in typewriters, or the like. This hole series will also be designated hereinafter as "apertured margin".

File folders of the above type serve for accommodating papers and can be provided with inscription directly by typewriters with or without carbon-copying.

Envelopes are known wherein two paper webs are glued to one another along periphral edges in such a manner that an insert sleeve is obtained. These paper webs are provided bilaterally with an apertured margin; the flaps for closing the sleeves are stamped from the paper web in accordance with the desired shape. The envelopes of this type serve principally for the dispatch of papers; they are less adapted for use as storage means in file systems because they are closed at least along three sides and therefore cannot be folded open.

It is further known to glue openable file folders with folded-in lateral flaps on carrier webs of indeterminate length. In such a structure, however, it is required that the file folders be made in a separate stamping and folding process and they have to be glued in a further work process on the carrier webs which also have to be separately manufactured. In such a structure, in the zone of the folded-in lateral flaps, a total of four material layers are superimposed. This results in a disadvantageous overall thickness of the web, particularly when it is used in connection with carbon copying. Particularly in certain rapid printers associated with electronic data processing, (hereinafter referred to as "rapid EDP-printers") it is impossible to type on envelope structures of this kind.

SUMMARY OF THE INVENTION

It is an object of the invention to provide an improved two-sheet file folder web which can be made in a simple manner and from which the above-discussed disadvantages are eliminated.

This object and others to become apparent as the specification progresses, are accomplished by the invention, according to which, briefly stated, the file folder web of indeterminate length formed of a series of interconnected individual file folders, each having a length and a width, has upper and lower sheets of indeterminate length arranged face-to-face and constituting, respectively, a front and a rear cover wall of each individual file folder; main weakened lines provided in the sheets and extending along and through the length dimension of each file folder; a strip of adhesive extending between the sheets along the length of each file folder adjacent the main weakened line along one longitudinal edge of each file folder for bonding together the sheets.

The invention makes possible to make file folders — which find application in an ever-increasing number in filing systems — from a web of indeterminate length and to provide them directly with inscription in typewriters, automatic printers, rapid EDP-printers, etc., with or without carbon copying.

Since a substantial number of file folders will be used to store only a small quantity of papers, it is important to utilize sheets which are as thin as possible, particularly in view of the fact that the rapid EDP-printers can handle only relatively thin paper. Since, however, the file folders are usually stored in an edgewise upright orientation, thin materials tend to curl or sag. Thus, to work with file folders behaving in this manner is quite difficult if not impossible. The disadvantage inherent in thin materials is eliminated according to the invention by folding inwardly the lateral flaps, whereby the stiffness and stability of the file folders are increased in a significant degree. It is advantageous according to the invention to provide the file folders with two adjacent, parallel-spaced fold lines for obtaining a Z-shaped bottom fold by folding backwards the front cover wall. By virtue of this bottom fold, the front wall is recessed to thus expose a strip-shaped zone which forms part of the rear cover wall and which may be provided with inscriptions. Further, such an exposed edge facilitates the grasping of the individual file folders within the file folder stack.

It is further advantageous to provide, according to the invention, each wall of the file folder with lateral flaps. In this manner, the stability of the file folders is increased and subdividing the papers stored in the file folder is possible.

According to another embodiment of the invention, the two face-to-face arranged sheets which, respectively, form the front cover wall and the rear cover wall of the serially interconnected file folders, are bonded to one another with strips of adhesive which, for each file folder in the web, have a rectangular course. Thus, one part of the adhesive strip in each folder extends in the direction of the folder width, whereas the other part of the adhesive strip extends in the length dimension of the folder. In this manner, after separating a file folder from the web by tearing along weakened (perforation) lines, there is obtained an individual file folder which is closed along two sides and is accessible through the other two sides which are disposed opposite the two bonded sides. It is advantageous to so design the web that the sheet which forms the rear cover walls is wider than the sheet which constitutes the front cover walls. In this manner, the edge zone of the rear cover wall which projects with respect to the front cover wall and which is associated with the open side of the file folder, can be used as an inwardly foldable lateral flap fold, whereas the edge zone projecting beyond the front cover wall at the other side, may be separated by tearing along weakened lines.

According to the invention it is further advantageous to provide the front cover wall of the file folder in the zone of the upper weakened line with a parallel-spaced further weakened line which joins at an angle the upper weakened line in the zone of the adhesive strip, whereby an easily tearable separating strip is provided. Upon removal of the separating strip, the rear cover wall is exposed, so that the file folder can be more easily grasped when positioned in a folder stack. It is often further advantageous to provide this zone of the rear cover wall with identifying inscriptions.

In accordance with the invention it is further advantageous to provide that the portion of the strip of adhesive which extends parallel to the length dimension of the web is a self-adhesive component disposed in the zone of the apertured web margins. In this manner, the apertured margin may be folded inwardly with the aid of the self-adhesive strip and thus the file folder can be sealed along a narrow side. This has the advantage over a direct bonding of the web sheets that the file folder, in the zone of the inwardly folded apertured margin, has an increased expansibility and thus is capable of receiving a larger quantity of papers to be stored therein.

In accordance with a further embodiment of the invention the layers constituting the front cover wall and the rear cover wall have identical widths in which case the apertured longitudinal margin constitutes an integral part of the file folder.

BRIEF DESCRIPTION OF THE DRAWINGS

FIG. 1 is a fragmentary top plan view of a file folder web of indeterminate length according to a preferred embodiment, wherein the file folders are oriented transversely to the length dimension of the web.

FIG. 2 is a cross-sectional view of the structure illustrated in FIG. 1.

FIG. 3 is a longitudinal sectional view of the structure illustrated in FIG. 1.

FIG. 4 is a perspective view of a file folder separated from the web illustrated in FIG. 1 and containing paper material stored therein and wherein one lateral flap is folded inwardly.

FIG. 5 is a cross-sectional view of a web having additional sheets for carbon copying.

FIG. 6 is a longitudinal sectional view of a web according to FIG. 1, folded in a zigzag manner.

FIG. 12 is a fragmentary top plan view of a file folder web of still another preferred embodiment of the invention, including a strip of adhesive that extends at right angles and wherein the sheet forming the rear cover wall is wider than the sheet forming the front cover wall.

FIG. 13 is a fragmentary top plan view of an embodiment similar to that illustrated in FIG. 12 wherein the two web sheets are of identical width.

FIG. 14 is a top plan view of a file folder separated from a file folder web shown in FIG. 13 and wherein the rear cover wall has an exposed, strip-shaped zone.

FIG. 15 is a fragmentary top plan view of a file folder web similar to FIG. 1 wherein there is provided a self-adhesive strip on the lower web sheet in the zone of the apertured longitudinal web margin.

FIG. 16 is a top plan view of a file folder separated from a file folder web shown in FIG. 14, wherein a lateral flap provided with a self-adhesive layer is folded inwardly and bonded to the front cover wall of the file folder.

DESCRIPTION OF THE PREFERRED EMBODIMENTS

Figure 7:
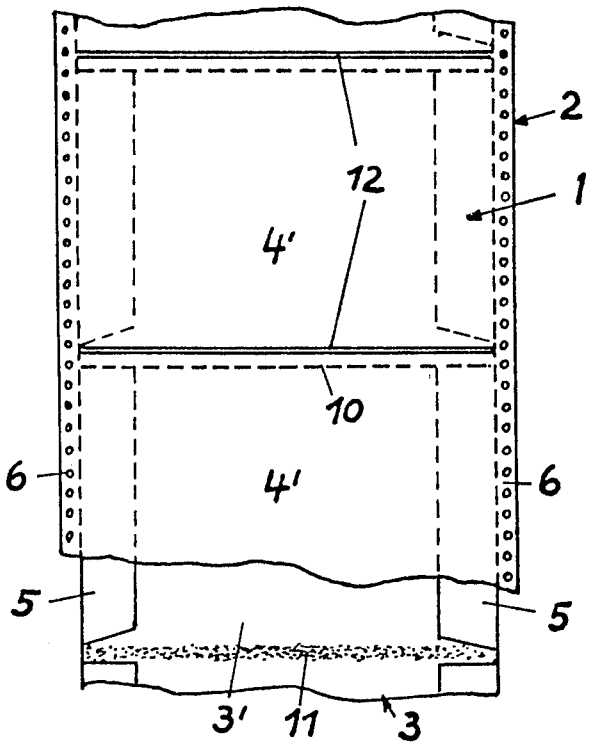
FIG. 7 is a fragmentary top plan view of a file folder web of indeterminate length according to another preferred embodiment of the invention, wherein the lateral flaps are folded in between the web sheets.

Turning now to FIG. 1, the file folders 1 are formed of a web 2 which comprises a relatively wide lower sheet 3 constituting the rear cover wall 3' of each file folder 1 with lateral flaps 5 and a relatively narrow upper sheet 4 constituting the front wall cover 4' of each file folder 1.

The sheet 3 has marginally and bilaterally extending holes 6 forming apertured margins for automatic typewriters as well as longitudinally extending fold lines 7 for forming the lateral flaps 5 of each file folder 1. The fold lines 7 on either side of each file folder are parallel to the adjacent web edge 8 and define therewith the width of the lateral flaps 5 of each file folder. The length of the lateral flaps 5 is determined by a cutting line 9 which extends preferably obliquely across the width of the lateral flaps 5 and by a weakened (perforation) line 10 extending transversely to the web 2 and determining the width of the file folder 1.

Parallel and adjacent to each weakened line 10 there extends a further weakened line 10' which is interrupted along a portion of its length and joins, at both sides of the interruption, the weakened line 10. The purpose of the weakened line 10' will become apparent later, in connection with FIG. 4.

Turning now to FIGS. 2 and 3, the second, relatively narrow upper sheet 4 is arranged centrally on the lower sheet 3 and is connected with the sheet 3 by means of a transversely extending strip of adhesive 11 which extends between the weakened ling 10 and a fold line 12 provided in the front wall 4'. As may be observed particularly in FIGS. 2 and 3, the adhesive strip 11 is arranged between single thicknesses (that is, along flapless portions) of the sheets 3 and 4. The sheet 4 is, with respect to the sheet 3, reduced in width by the width of the lateral flaps 5. The weakened lines 10 extend transversely to the web 2, their distance $x$ corresponds to the width of the file folder 1. The lines 10 further serve as fold lines for a zigzag folding of the web 2 (FIG. 6) as well as tear lines for separating the individual file folders 1 from one another.

Turning now to FIG. 4, there is shown an individual file folder 1, separated from the file folder web. It is seen that by removing and discarding the strip bounded by adjacent weakened lines 10 and 10' (FIG. 1), there is obtained, on the edge of the rear cover wall 3' and the front cover wall 4', an index tab 10''.

Turning now to FIG. 5, the web 2 may be provided with sets 13 for carbon copying; they comprise alternating paper sheets 13' and carbon papers 13'' which are expediently connected at adhesive locations 14 with one another and with the upper sheet 4.

The file folder 1 designed in the above-described manner and which may be provided with a carbon copying set 13, can be printed upon in rapid EDP-printers, automatic printers, conventional typewriters or the like. Thus, for example, in a buying department of a firm, for each purchasing order an order form set — comprising a carbon copy set 13 combined with a file folder 1 — can be completed on an automatic printer, rapid EDP-printer, or the like, in a single operational step. The essential data of the purchase order are copied onto the front face of the front cover wall 4' of the file folder 1. The papers prepared in connection with such purchase order can be stored directly in the file folder 1. The lateral flaps 5 are, for this purpose, folded inwardly onto the papers 15 positioned in the file folder, as shown in FIG. 4.

Turning now to the embodiment illustrated in FIG. 7, the lateral flaps 5 of the sheet 3 are folded inwardly between the sheets 3 and 4 prior to gluing together the two sheets 3 and 4 subsequent to the removal of a stamping waste 9'. The apertured longitudinal margins 6 which may be removed along weakened (perforation) lines are preferably arranged on the sheet 4. Upon separation of the web 2, the individual file folder 1 is ready to receive papers 15 without the necessity of further manual folding operations.

Figure 8:
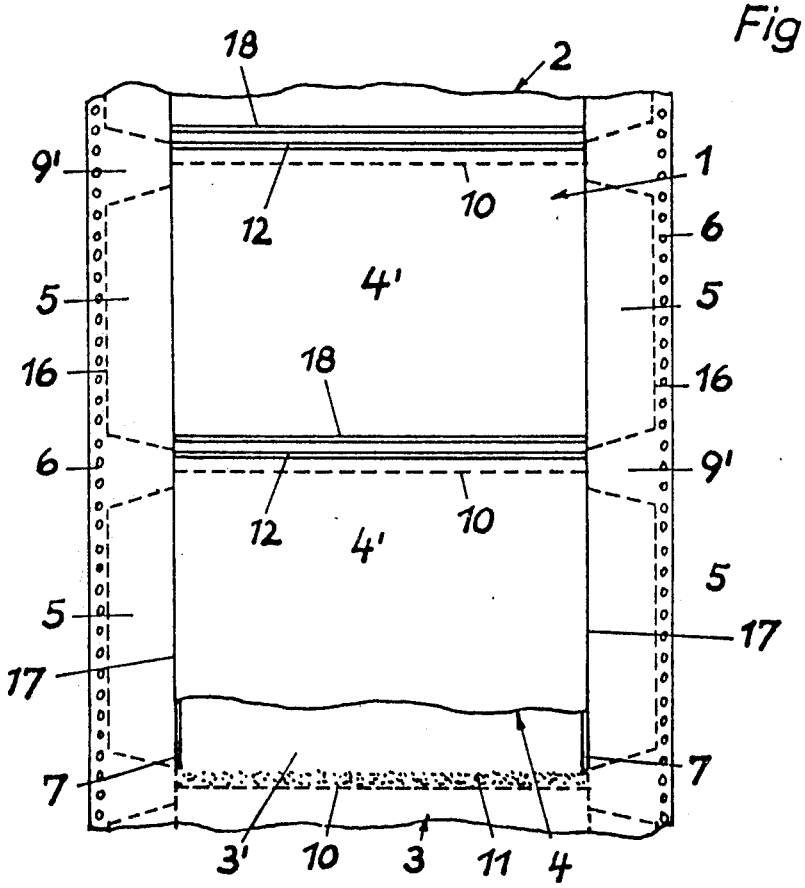
FIG. 8 is a fragmentary top plan view of another preferred embodiment of a file folder web of indeterminate length, wherein the front wall of each file folder has an additional fold line and the apertured margins may be detached.
Figure 9:
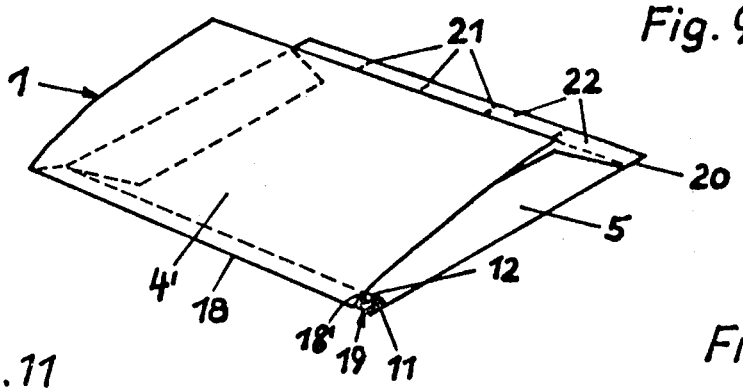
FIG. 9 is a perspective view of a closed file folder separated from the web structure of FIG. 8.

FIGS. 8 and 9 illustrate a further embodiment of the invention. The sheets 3 and 4 are glued to one another between the fold line 12 of the layer 4 and the weakened line 10 passing through the two sheets 3 and 4. The weakened line 10 extending transversely to the web 2 cuts through the sheets 3 and 4 in the width of the sheet 4. The apertured margin 6 of the sheet 3 may be removed by tearing along a weakened line 16. The latter extends in the zone of the strip of adhesive 11 in a U-shaped or trapezoid-shaped configuration inwardly to the longitudinal edge 17 of the sheet 4. In this manner, the lateral flaps 5 are reduced in length so that they can be folded along the fold line 7 and inserted between the two sheets 3 and 4 without any difficulty.

A further fold line 18 is provided adjacent and parallel to the fold line 12 to make possible a Z-shaped fold 19 of the front cover 4'. In this manner the papers 15 to be stored may be inserted into the inner fold 18' of the fold line 18. This has the advantage that in case of an upright positioning of the file folder 1, the papers stored therein are in an upright orientation in the fold 18' on a support surface.

By virtue of the Z-shaped fold 19 of the front cover wall 4', the latter is recessed downwardly and thus exposes a strip-shaped edge zone 20 of the rear wall cover 3' for carrying, for example, an identifying inscription for the file folder. The reduced length of the flaps 5 ensure that the zone 20 is available for inscription along the entire length of the rear cover wall 3'. The edge zone 20 may be provided with inscription by means of a typewriter. In such a case the back face of the front cover wall 4' is provided, in the zone of the strip 20, with a copying coating so that any text provided on the front cover wall 4' will be carbon-copied onto the strip 20.

The edge strip 20 may be subdivided by weakened lines 21, so that upon removal of selected sections 22, a sole tab portion (carrying the inscription) remains attached to the rear cover wall 3'.

In case the strip of adhesive 11 is recessed in width with respect to the fold line 12, it is possible to insert individual papers with an edge zone into the unglued zone between the fold line and the upper edge of the adhesive strip. Such papers then will be separated from the other papers positioned in the file folder.

Figure 11:
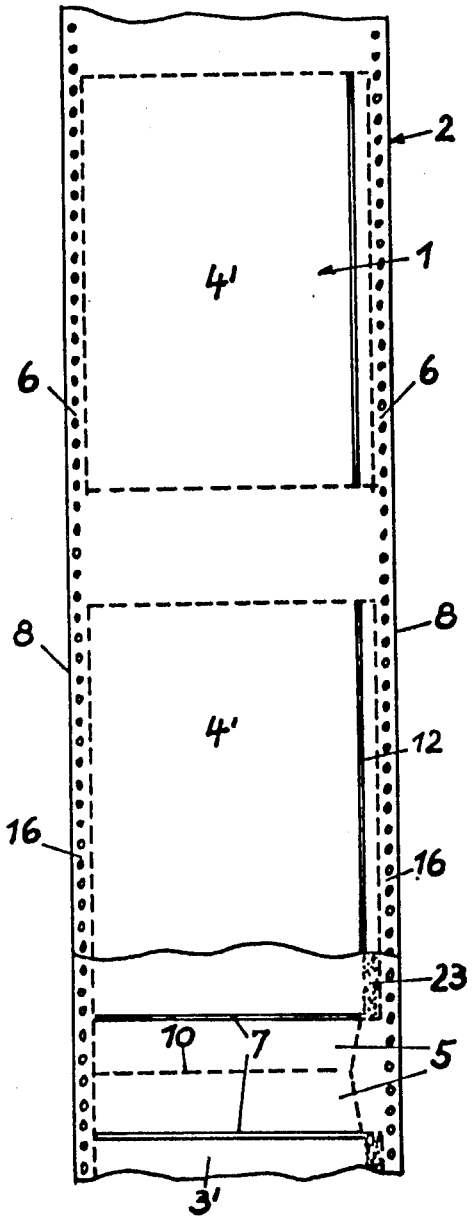
FIG. 11 is a fragmentary top plan view of a file folder web of still another preferred embodiment of the invention, wherein the front walls of the file folders are formed without lateral flaps.
Figure 10:
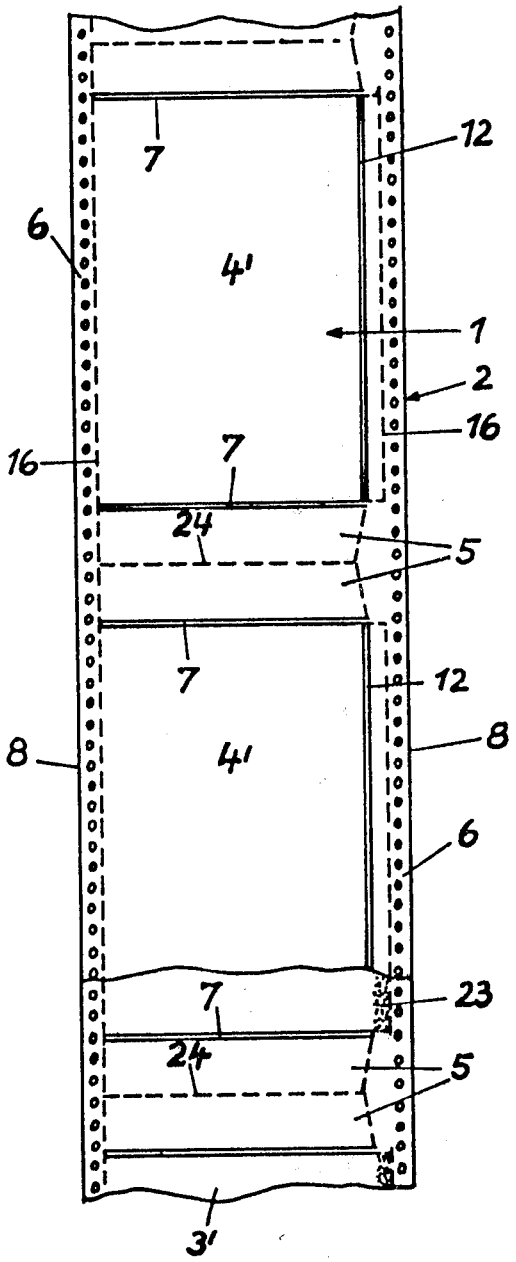
FIG. 10 is a fragmentary top plan view of a further preferred embodiment of the file folder web of indeterminate length, wherein the file folders are oriented longitudinally with respect to the length dimension of the web.

According to a further embodiment of the invention illustrated in FIG. 10, the strip of adhesive 23 extends parallel to the longitudinal edges 8 of the web 2. The lateral flaps 5 are positioned above and below the file folders 1, as viewed in FIG. 10. Thus, the length of the folders is oriented in the longitudinal direction of the web. Adjoining flaps 5 of successive file folders are connected by transversal weakened lines 24. The front cover wall 4' and the rear cover wall 3' each may be provided with two lateral flaps 5. If, however, the lateral flaps 5 are provided only on one cover, for example on the rear cover wall 3', the weakened lines 24 do not extend through both sheets 3 and 4, but only through the sheet 3, as illustrated in FIG. 11.

Turning now to FIG. 12, the upper sheet 4 which is narrower than the lower sheet 3 and which is centrally positioned thereon, is glued to the sheet 3 by means of a composite strip of adhesive which has a first portion 11 extending transversely to the length dimension of the web and a second portion 11' which extends parallel to the length dimension of the web. The adhesive strip portion 11' serves to seal a narrow side of the file folder 1. The distance $x$ between two parallel extending transversal weakened lines 10 defines the width of a file folder.

According to the embodiment illustrated in FIGS. 13 and 14, the sheets 3 and 4 are of identical width. There is further provided a weakened line 14 which is parallel-spaced with respect to the weakened line 10 and extends adjacent thereto. Thus, by removing by tearing, the strip bounded by the weakened lines 10 and 14 from the front cover wall 4', a strip zone 15 of the rear cover wall 3' will be exposed as illustrated in FIG. 14. This strip zone 15 may be provided with an identifying inscription. In the embodiment shown in FIGS. 13 and 14, the apertured margins (holes 6) of the file folder constitute a permanent, integral part thereof.

Turning now to the embodiment illustrated in FIGS. 15 and 16, the adhesive portion which extends parallel to the length of the web is constituted by a self-adhesive (pressure-sensitive) band 11'' arranged in the zone of an apertured margin.

Upon removal of a protective strip (not shown) which, before use, covers the self-adhesive coating, the apertured margin can be folded inwardly and bonded to the front cover wall 4' of the file folder 1 as illustrated in FIG. 16. In this manner the file folder 1 is closed at one narrow side. It is to be understood that it is also possible to provide the self-adhesive coating 11' at the back side of the sheet 3 and then fold the apertured margin 6 inwardly into the file folder 1 so that it adheres to the inside of the front cover wall 4'.

The file folders 1 designed in accordance with FIGS. 12–16 are accessible from two sides which lie opposite the rectangularly extending strip of adhesive. The file folder can thus be partially unfolded for insertion of papers thereinto.

It will be understood that the above description of the present invention is susceptible to various modifications, changes and adaptations, and the same are intended to be comprehended within the meaning and range of equivalents of the appended claims.

What is claimed is:

1. A file folder web of indeterminate length formed of a series of interconnected individual file folders each having a length and a width, comprising in combination:

a. upper and lower sheets of indeterminate length arranged face-to-face and constituting, respectively, a front and a rear cover wall of each individual file folder;

b. main weakened lines provided in said sheets and extending along and through the length of each file folder;

c. a strip of adhesive extending between said sheets along the length of each file folder adjacent the main weakened line along one longitudinal edge of each file folder for bonding together said sheets; said strip of adhesive being the sole strip of adhesive in each individual file folder; and d. a fold line extending in one of said sheets parallel to and adjacent said main weakened lines; said strip of adhesive extending between the main weakened line along said longitudinal edge and said fold line.

2. A file folder web as defined in claim 1, wherein the length dimension of each individual file folder extends parallel to the web length.

3. A file folder web as defined in claim 1, further including lateral flaps attached to the edges of at least one of said cover walls along the width of each individual file folder; said lateral walls being in a folded-out condition; and additional weakened lines in said sheets, said additional weakened lines extending transversely to the web length and separating two adjoining lateral flaps from one another; said adjoining lateral flaps forming part of two different, adjoining individual file folders in said web.

4. A file folder web as defined in claim 1, wherein said upper sheet is narrower than said rear sheet.

5. A file folder web as defined in claim 4, wherein said sheets are arranged centrally with respect to one another.

6. A file folder web as defined in claim 1, further comprising means provided in each front cover wall for recessing it with respect to the rear cover wall in each file folder for exposing a marginal zone of said rear cover wall, said marginal zone extending parallel to the length dimension of said file folder.

7. A file folder web as defined in claim 6, wherein said means includes an additional fold line in each front cover wall, said additional fold line extending adjacent and parallel-spaced from said main fold line.

8. A file folder web as defined in claim 1, further including lateral flaps attached to the edges of at least one of said cover walls along the width of each individual file folder.

9. A file folder web as defined in claim 8, wherein said lateral flaps are provided on said rear cover wall of each individual file folder.

10. A file folder web as defined in claim 8, wherein said lateral flaps are provided on said front cover wall and said rear cover wall of each individual file folder.

11. A file folder web as defined in claim 8, wherein said lateral flaps are in a folded-out condition in said web.

12. A file folder web as defined in claim 8, wherein said lateral flaps are in a folded-in condition and are positioned between said front and rear cover walls.

13. A file folder web as defined in claim 1, wherein the length of each individual file folder extends transversely to the web length; said main weakened lines connecting the individual file folders to one another.

14. A file folder web as defined in claim 13, further comprising additional sheets arranged face-to-face to one another on said rear sheet, said additional sheets constituting a carbon-copying set.

15. A file folder web as defined in claim 13, further comprising an additional weakened line provided in said upper sheet within the outline of each individual folder; said additional weakened line extending parallel to and adjacent the main weakened line remote from said strip of adhesive; said additional weakened line having a discontinuity along the length of the file folder and joining said main weakened line at each end of said discontinuity to provide a tab portion in a longitudinal edge of the individual file folders.

16. A file folder web as defined in claim 13, further comprising apertured margins extending longitudinally along both edges of said web; additional weakened lines provided in said sheets and extending in the direction of the web length adjacent and inwardly of each said apertured margin for detaching each said apertured margin from each individual file folder.

17. A file folder web as defined in claim 13, further including lateral flaps attached to the edges of at least one of said cover walls along the width of each individual file folder, said lateral flaps being in a folded-out condition.

18. A file folder web as defined in claim 13, further comprising apertured margins extending longitudinally along both edges of said web; said apertured margins being located within the outline of said lateral flaps and forming a permanent, integral part thereof.

19. A file folder web of indeterminate length formed of a series of interconnected individual file folders each having a length and a width, comprising in combination:

a. upper and lower sheets of indeterminate length arranged face-to-face and constituting, respectively, a front and a rear cover wall of each individual file folder;

b. Main weakened lines provided in said sheets and extending along and through the length of each file folder;

c. a strip of adhesive extending between said sheets along the length of each file folder adjacent the main weakened line along one longitudinal edge of each file folder for bonding together said sheets; and d. an additional weakened line provided in said upper sheet within the outline of each individual folder; said additional weakened line extending parallel to and adjacent the main weakened line remote from said strip of adhesive; said additional weakened line having a discontinuity along the length of the file folder and joining said main weakened line at each end of said discontinuity to provide a tab portion in a longitudinal edge of the individual file folders.

* * * * *